United States Patent [19]

Janson

[11] 4,116,759

[45] Sep. 26, 1978

[54] PREPARATION OF LIQUOR FOR DELIGNIFICATION OR ALKALI TREATMENT BY AUTOCAUSTIZATION, AND THE PREPARATION OF PULP WITH THIS LIQUOR

[76] Inventor: Jan Janson, Granbackagränden 3B22, 02210 Espoo 21, Finland

[21] Appl. No.: 719,139

[22] Filed: Aug. 31, 1976

[30] Foreign Application Priority Data

Sep. 2, 1975 [FI] Finland ..... 752463

[51] Int. Cl.[2] ..... D21C 11/12

[52] U.S. Cl. ..... 162/32; 162/65; 162/80

[58] Field of Search ..... 162/80, 30 R, 30 K, 162/32, 65, 79

[56] References Cited

U.S. PATENT DOCUMENTS

| | | | |
|---|---|---|---|
| 1,643,826 | 9/1927 | Summers | 162/80 |
| 1,730,383 | 10/1929 | Richter | 162/80 |
| 1,868,569 | 7/1932 | Dils | 162/80 |
| 1,935,580 | 11/1933 | Richter | 162/80 |
| 2,601,110 | 6/1952 | Fisher et al. | 162/79 |
| 2,673,148 | 3/1954 | Harris | 162/65 |
| 3,024,158 | 3/1962 | Grangaard et al. | 162/65 |
| 3,594,270 | 7/1971 | Schattner et al. | 162/80 |
| 3,661,699 | 5/1972 | Farley | 162/80 |

*Primary Examiner*—Richard V. Fisher
*Assistant Examiner*—William F. Smith
*Attorney, Agent, or Firm*—Andrus, Sceales, Starke & Sawall

[57] ABSTRACT

A method for the regeneration of pulping or bleaching chemicals from spent liquor containing salts of polybasic organic acids. The liquor is evaporated and then burned so that organic matter will be discharged as carbon dioxide and water, and a carbonate residue is formed. Carbon dioxide is expelled from the carbonate with an acid by autocaustization to regenerate the cooking chemicals.

8 Claims, 3 Drawing Figures

○ ● ▽ ▼ Na: B = 2.0, NO ORGANIC COMPOUNDS.

□ Na: B = 2.0 (875° C) ORG. COMPOUNDS PRESENT

AUTOKAUSTISATION AT 875°C / $3^h$ $30^{min}$

○ X = B (BORATE)

● X = P (PHOSPHATE)

——— EXPERIMENTAL CURVES

– – – – THEORETICAL CURVES (COMPLETE REACTION AND NO LOSSES)

PREPARATION OF LIQUOR FOR DELIGNIFICATION OR ALKALI TREATMENT BY AUTOCAUSTIZATION, AND THE PREPARATION OF PULP WITH THIS LIQUOR

BACKGROUND OF THE INVENTION

When alkaline spent pulping liquors are burnt to yield chemicals and heat, one of the main products is sodium carbonate. In the case of black liquor from kraft cooks, sodium sulfide will also be formed. The product is dissolved in water into so-called green liquor after the passage through the recovery furnace. As a rule, the carbonate is usually not sufficiently alkaline to pulp wood or similar fibrous material to an adequate degree. The carbonate is consequently transformed into hydroxide. This process is called caustisation, and is conducted with the aid of a metal hydroxide solution, of which the corresponding carbonate has a low solubility in water. In practice, calcium hydroxide is used for the caustisation. In addition to soluble sodium hydroxide, insoluble calcium carbonate is also formed (lime sludge), which is usually separated, heated (lime sludge reburning), until it has been transformed into calcium oxide and is then dissolved into new calcium hydroxide. Caustisation requires both equipment and time, and if it could be avoided this would mean a considerable saving for a pulp mill.

SUMMARY OF THE INVENTION

The present invention is intended to eliminate the caustisation by addition of a chemical and separation of a byproduct, as used in the past. This can be achieved by the use of chemicals other than the conventional ones by alkaline pulping processes. Since alkali is required also for the bleaching of pulp, conventional bleaching alkali can be substituted by chemicals, which can be regenerated according to the present invention.

Another advantage in cooking and bleaching with these chemicals is, that a more even pH value is obtained, and thereforeless carbohydrate degradation.

In addition, the chemicals can be used for alkali treatment of pulp that has already been made, for example, in connection with viscose preparation. Also such liquor can be prepared according to the invention.

DESCRIPTION OF THE DRAWINGS

The drawings illustrate the best mode presently contemplated of carrying out the invention.

In the drawings.

DESCRIPTION OF THE PREFERRED EMBODIMENT

The caustisation procedure according to the invention will hereinafter be called autocaustisation. It is applicable if use is made of certain salts of polyprotic inorganic acids, such as boric or orthophosphoric acid, as pulping chemicals (or bleaching chemicals — generally: delignification chemicals). After such use, the liquor is evaporated and burnt, whereafter in the main its content of organic matter will have been transformed into carbon dioxide and water, whereby part of the carbon dioxide will be bound in the form of carbonate to the non-volatile residue ("ash" or "melt", depending upon the temperature). At a sufficiently high temperature, the carbon dioxide is expelled from the carbonate without the addition of a separate chemical. In principle. the following three stages can be noticed for the alkali, where the $Na_2HBO_3$ and alkali-consuming organic matter in the cook, such as lignin, by LignOH.

1. Cooking or bleaching (delignification):

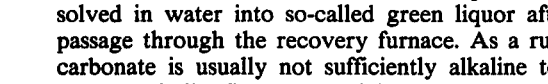

$$Na_2HBO_3LignOH \rightleftarrows LignONa + NaH_2BO_3$$

2. Combustion:

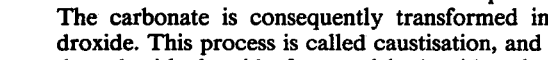

$$2\ LignONa + x.O_2 \rightarrow Na_2CO_3 + y.CO_2 + z.H_2O$$

3. Autocaustisation:

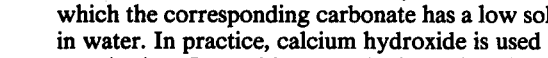

$$2NaH_2BO_3 + Na_2CO_3 \rightarrow 2Na_2HBO_3 + CO_2 + H_2O$$

The principle of autocaustisation is based on the fact that one can expel the carbon dioxide from carbonate with an acid, $H_2BO_3$, which is weaker than carbon dioxide, provided one or several reaction products (in this case $CO_2$ and $H_2O$) are removed from the system. The equilibrium in reaction 3 may thus be inclined to the left, but since $CO_2$ and $H_2O$ are allowed to leave continuously, the product $Na_2HBO_3$ can be obtained in a theoretical yield. However, it should be noted that the cooking chemical in both its uncausticised and its causticised form ($NaH_2BO_3$ and $Na_2HBO_3$, resp) should be non-volatile; it normally is so if it is a sodium salt. If the causticised product $Na_2HBO_3$ is sufficiently alkaline, it is usable as a delignification chemical. This is the case with secondary sodium borate, $Na_2HBO_3$, which has been shown approximately to correspond equimolarly to NaOH as effective alkali during alkaline pulping.

The salt $Na_2HBO_3$ does not exist as such in a dry state, but dehydrated, viz. according to the formula:

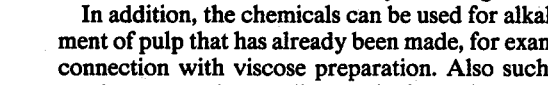

$$2\ Na_2HBO_3 \rightleftarrows Na_4B_2O_5 + H_2O$$

However, by redissolution in water the salt is hydrolysed back to orthoborate. In the subsequent text, $Na_2HBO_3$, and generally $Na_{m+1}H_{n-1}A$, are also allowed to represent such salts of corresponding polynuclear ions.

The borate salt is used in a concentration of 0.1 to 2.0 mols of boron/liter so that during the pulping or bleaching process 0.2 to 2.0 mols of hydroxyl ions per mol of boron are liberated through hydrolysis of the salt.

The borate in the residual liquor has a molar ratio of Na:B of 1 - 2 (excluding Na present as $Na_2S$) and is combusted at a temperature of 200° 1 C. to 1500° C., with dissolution of the residue in water following.

Figure 1:
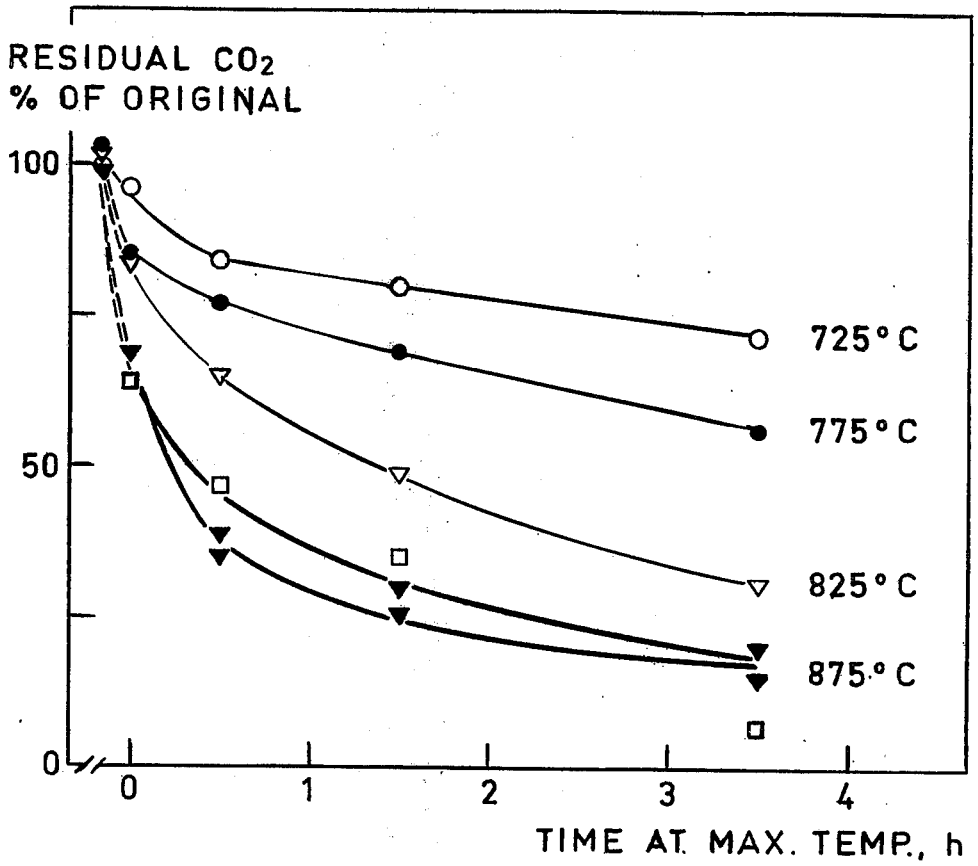
FIG. 1 is a graphic illustration of the completeness of caustisation of a given borate-carbonate ratio at different temperatures.
Figure 2:
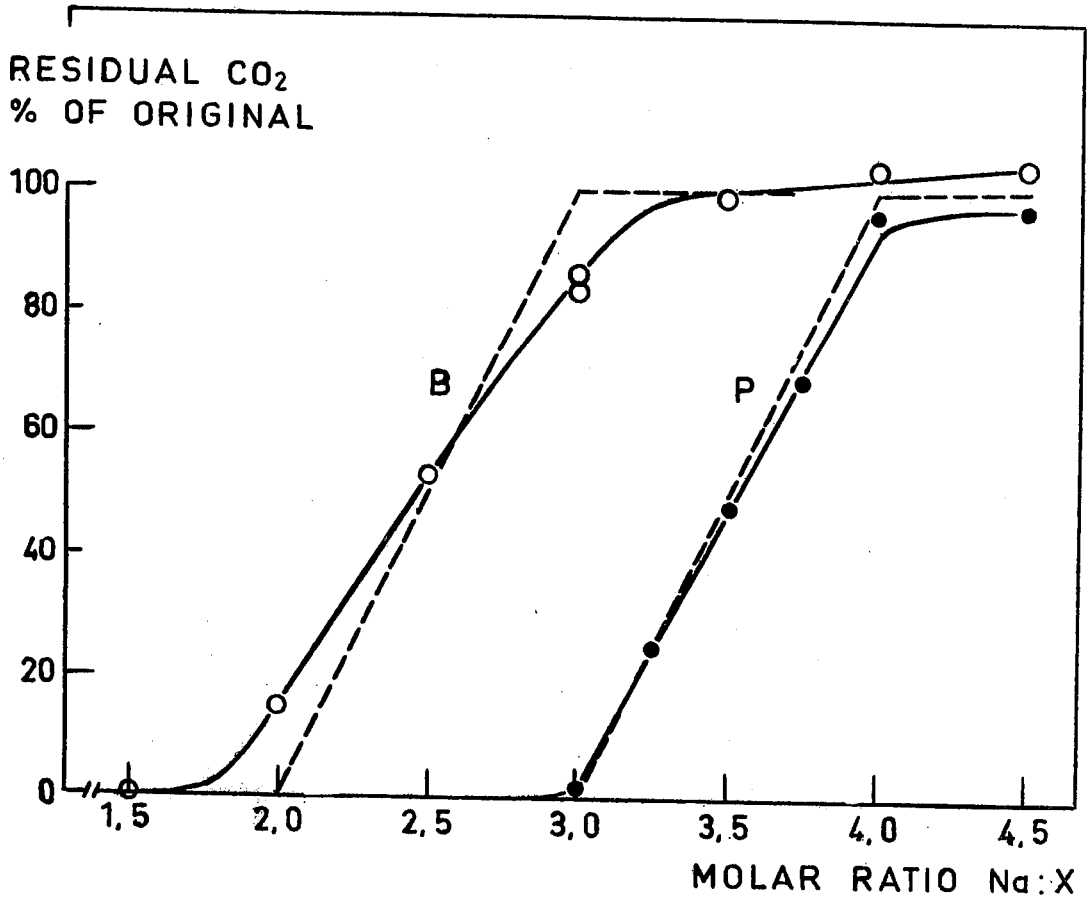
FIG. 2 is a graphic illustration showing the completeness of caustisation of various molar ratios of borates and phosphates.

The conditions needed for autocaustisation depend upon the nature of the chemical concerned. As is shown in FIG. 1, one can achieve with a mixture of 2 mol $NaH_2BO_3$ and 1 mol $Na_2CO_3$ (when thus the total molar ratio F = Na:B is equal to 2.0), by heating at 875° C. for 3 h there is attainable a degree of caustisation of 80% (20% $CO_2$ of original amount remaining). Caustisation experiments with the same borate-carbonate mixture have been performed within the temperature interval 725°-875° C. (see FIG. 1) for times between 0 and 3 h 30 min. It appeared that the decomposition of the carbonate approximately followed first order kinetics, and that the reaction constant k (is $s^{-1}$) could be calculated by means of the equation:

$$\ln k = 2.67 - (13350/T)$$

where T is the absolute temperature in K (Kelvin). The energy of activation was 111 kJ/mol, which may for example mean, that the reaction speed is doubled if the temperature is increased from 875° to 947° C.; If the molar ratio F varies, it is obvious that it is easy to causticise if $F \leqq 2$, but not if $F > 2$ (see FIG. 2). This is also to be expected, since if $F > 2$, the mixture will consist of $NaH_2BO_3$ and $Na_2CO_3$, and carbon dioxide can be expected to be expelled by the ion $H_2BO_3$ (whereby $HBO_3^{2-}$ will be formed), but not by the ion $HBO_3^{2-}$, which is not a sufficiently strong acid.

Analogous experiments with phosphate have shown, that it is possible to perform the following autocaustisation:

$$2\ Na_2HPO_4 + Na_2CO_3 \rightarrow 2\ Na_3PO_4 + CO_2 + H_2O$$

Figure 3:
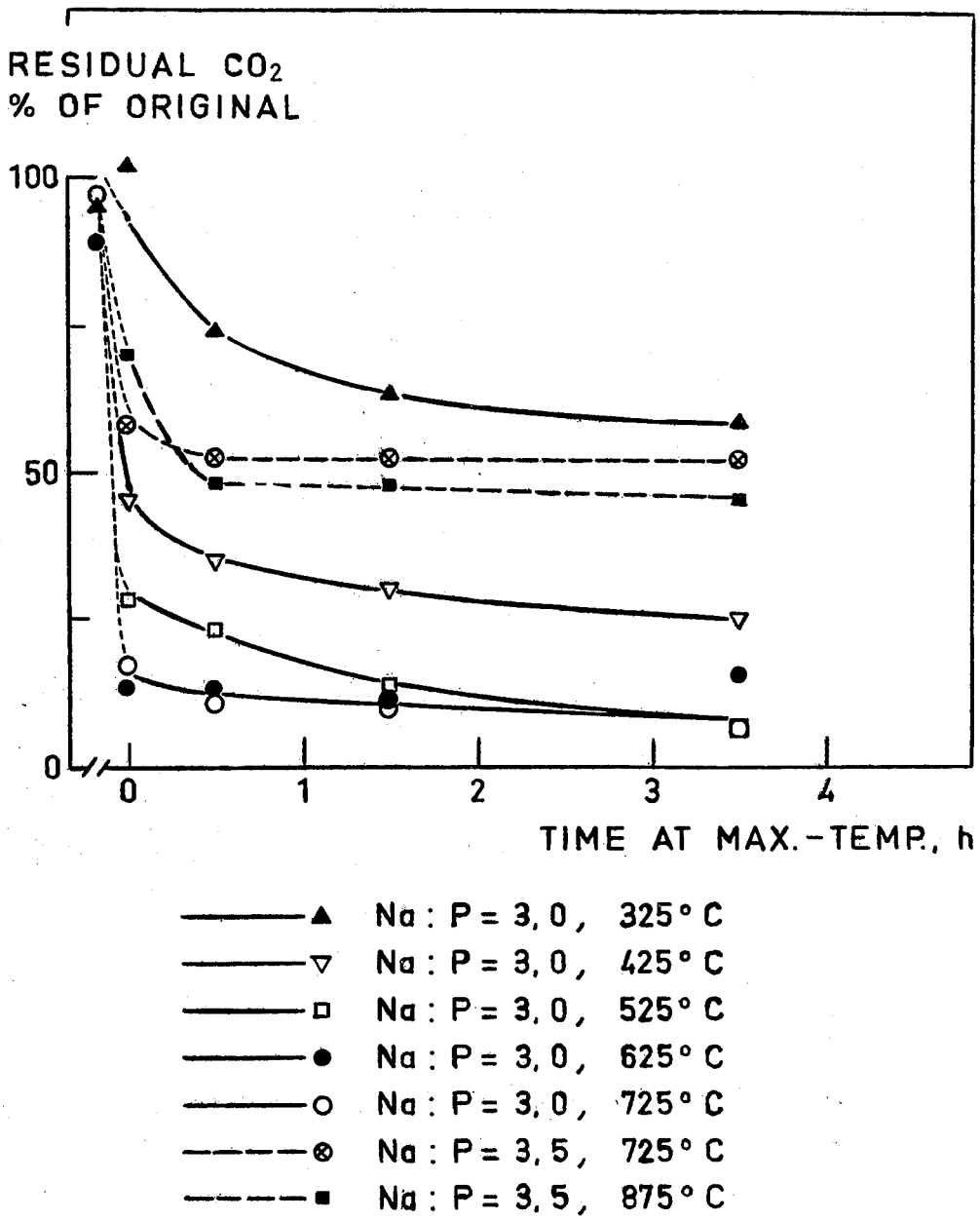
FIG. 3 is a graphic illustration showing the completeness of caustisation of various molar ratios of phosphates at different temperatures.

As is shown in FIG. 3, after about 40 min at 525° C. 80% of the carbon dioxide has been expelled, and at 625°–725° C. as much as 90%. If the molar ratio G = Na:P exceeds 3, caustisation will be incomplete (see FIG. 2); if $G \geqq 4$, no caustisation will occur. For example, if G = 3.5, the mixture will be causticised half-way (FIG. 3):

$$Na_3PO_4 + Na_2HPO_4 + Na_2CO_3 \rightarrow 2\ Na_3PO_4 + \tfrac{1}{2}Na_2CO_3 + \tfrac{1}{2}CO_2 + \tfrac{1}{2}H_2O$$

Thus, for borate - and phosphate liquor it is essential to keep F = Na/B $\leqq 2$ and G=Na:P $\leqq 3$, respectively, to ensure complete caustisation. Salts of other amphoteric electrolytes silicates and aluminates, such as might also be used analogously.

Experiments have also been made with organic substance present during the heating of borate- and phosphate salts in the presence of air, to simulate the burning and caustisation of real spent liquors. Thus, $Na_2HBO_3$ and $Na_3PO_4$, respectively, have been mixed with vanilline and glucose (and some water) and heated in a laboratory oven. The caustisation then proceeded a little more slowly than when pure carbonate was present instead of the organic compounds, see Fig. 1.

Examples are given below from experiments with real pulping spent liquors (birch liquors, corresponding to pulp yields of 65–79%):

| Composition of original cooking liquor | Theoretical amount after combustion of 1 l spent liquor, mmol | | | | Found amount after combustion and heating of 1 l spent liquor, mmol | | | | Degree of caustisation | Main product after dissolution |
|---|---|---|---|---|---|---|---|---|---|---|
| | Na | B | P | $CO_2$ | Na | B | P | $CO_2$ | % | |
| NaOH | 1000 | — | — | 500 | 881 | — | — | 283 | 36 | $Na_2CO_3$ |
| $Na_2HBO_3$ | 1740 | 870 | — | 435 | 1686 | 949 | — | 23 | 95 | $Na_2HBO_3$ |
| $NaBO_3$ | 550 | 550 | — | 0 | 523 | 518 | — | 3 | — | $NaH_2BO_3$ |
| $Na_3PO_4$ | 3750 | — | 1250 | 625 | 3986 | — | 1340 | 76 | 89 | $Na_3PO_4$ |

The degree of caustisation refers to that part of the carbonate formed during combustion which has expelled its $CO_2$ during heating.

It is thus obvious that one can burn and regenerate borate- and phosphate spent liquors by heating (autocaustisation) in such a way as to give liquors which are re-usable as alkali for the preparation of pulps.

Both kraft and "soda" cooking can be done with borate or phosphate instead of hydroxide as alkali, as can bleaching, for instance oxygen bleaching.

Examples of birch kraft cooks at a liquor - to - wood ratio of 3.6, and to a H-factor of 981:

| Cooking chemicals, mol/l | | | Total yield % of wood | Screenings % of wood | Lignin % | Degree of delignification |
|---|---|---|---|---|---|---|
| $Na_2S$ | NaOH | $Na_2HBO_3$ | | | | |
| 0.20 | 0.98 | — | 52.4 | 0.1 | 3.8 | 0.90 |
| 0.22 | — | 1.14 | 52.4 | 0.2 | 3.1 | 0.92 |

An example is given below of "soda" cooks of birch (liquor - to - wood ratio 4.0):

| Cooking chemicals, mol/l | | | H factor | Total yield % of wood | Lignin % | Degree of delignification |
|---|---|---|---|---|---|---|
| NaOH | $Na_2HBO_3$ | $Na_3PO_4$ | | | | |
| — | 0.61 | — | 533 | 69.4 | 21.2 | 0.29 |
| 0.80 | — | — | 482 | 68.1 | 20.1 | 0.34 |
| — | — | 1.50 | 482 | 69.9 | 21.0 | 0.29 |

From a number of kraft and alkali cooks of birch it has been found, that 1 mol $Na_2HBO_3$ corresponds to 1.2 mol NaOH, and that 1 mol $Na_3PO_4$ corresponds to about 0.5–0.6 mol NaOH during cooking.

The following oxygen bleaching experiments may be presented as examples of the use of weakly-alkaline $NaH_2BO_3$. The starting material was birch alkali pulp, cooked to the yield 67.4%, and with lignin content 21.7%. During the bleaching, the pulp consistency was 10%, the oxygen pressure 8 bar, the maximum temperature 120° C. and the time at 120° C. 45 min.

| Alkali, mol/l | | Final pH | Total yield, % after bleaching | Lignin % | Degree of delignification | Viscosity SCAN $dm^3/kg$ | Brightness SCAN % |
|---|---|---|---|---|---|---|---|
| NaOH | $NaH_2BO_3$ | | | | | | |
| 0.29 | — | 10.9 | 54.9 | 11.2 | 0.70 | 690 | 33.0 |
| — | 0.60 | 9.9 | 57.0 | 11.1 | 0.70 | 740 | 32.1 |

In this case the advantage with weak alkali was that at a certain lignin content the yield was about 2 abs. % higher.

According to the invention, it is thus possible to use alkaline borate, such as $Na_2HBO_3$, instead of hydroxide during pulping, and it is also possible, after the organic material in the spent liquor has been burnt into carbonate, to causticise the remainder by heating, so as to obtain new alkaline liquor suitable for use in pulping. Alkali losses during the pulping cycle may be covered by borax and soda. Analogously, bleaching alkali may be prepared, and also analogously, other inorganic chemicals may be used.

Various modes of carrying out the invention are contemplated as being within the scope of the following claims particularly pointing out and distinctly claiming the subject matter which is regarded as the invention.

I claim:

1. A method for the alkali pulping of ligno-cellulose materials, comprising the steps of cooking the ligno-cellulose material in an alkaline aqueous cooking liquor containing as an active ingredient at least one alkaline salt of a polybasic inorganic acid selected from the group consisting of $NaH_2BO_3$ and $Na_2HBO_3$, combusting the residual cooking liquor to obtain an alkaline inorganic substance, and dissolving said inorganic substance in water to provide the same alkaline salt as used in the cooking step.

2. The method of claim 1, wherein the polybasic acid is boric acid and the borate salt is used in a concentration of 0.1–2.0 mol B/1 and so that during the pulping process 0.2–2.0 mols of hydroxyl ions per mol of boron are liberated through hydrolysis of the salt.

3. The method of claim 1, wherein the liquor is evaporated prior to combusting.

4. The method of claim 1 wherein the acid is boric acid, and the borate in said residual liquor has a molar ratio Na:B of 1–2 (excluding Na present as $Na_2S$) and is combusted at a temperature of 200° C. to 1500° C.

5. A method for the alkaline bleaching of pulp derived from ligno-cellulose materials, the steps comprising bleaching the pulp in the presence of oxygen in an aqueous alkaline liquor containing as an active ingredient at least one alkaline salt of a polybasic inorganic acid selected from the group consisting of $Na_2HBO_3$ and $NaH_2BO_3$, combusting the residual liquor to obtain an alkaline inorganic substance, and dissolving the inorganic substance in water to form the same alkaline salt used in the bleaching step.

6. The method of claim 5, wherein the alkaline salt is used in a concentration of 0.1 to 2.0 mols of boron/1 so that during the bleaching process 0.2 to 2.0 mols of hydroxyl ions per mol of boron are liberated through hydrolysis of the salt.

7. The method of claim 5, wherein the liquor is evaporated prior to combustion.

8. The method of claim 5, wherein the alkaline salt in said residual liquor has a molar ratio of Na:B of 1–2 (excluding Na present as $Na_2S$) and is combusted at a temperature at 200° C. to 1500° C.

* * * * *

UNITED STATES PATENT AND TRADEMARK OFFICE

CERTIFICATE OF CORRECTION

PATENT NO. : 4,116,759

DATED : September 26, 1978

INVENTOR(S) : JAN JANSON

It is certified that error appears in the above-identified patent and that said Letters Patent are hereby corrected as shown below:

Column 2, Lines 13, After "$Na_2NBO_3$" insert ---+--- (a plus sign), Column 2, Line 55, Cancel "200° 1C" and substitute therefor ---200°C---, Column 3, Line 1, Cancel "k(is $s^{-1}$)" and substitute therefor ---k(in $s^{-1}$)---

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*